US005922661A

United States Patent [19]

Duccini et al.

[11] Patent Number: 5,922,661

[45] Date of Patent: Jul. 13, 1999

[54] LOW/NON-PHOSPHATE DETERGENT TABLETS COMPRISING NEUTRALIZED POLYMER BINDER INCORPORATED THEREIN

[75] Inventors: Yves Duccini, Beauvais; Paul Francis David Reeve, Valbonne, both of France; Charles Elwood Jones, Yardley, Pa.; Francois Gauthier, Verneuil en Halatte, France

[73] Assignee: Rohm & Haas Company, Philadelphia, Pa.

[21] Appl. No.: 09/201,601

[22] Filed: Nov. 30, 1998

Related U.S. Application Data

[63] Continuation of application No. 08/872,038, Jun. 10, 1997, Pat. No. 5,883,061.

[30] Foreign Application Priority Data

Jun. 14, 1996 [FR] France ..... 96-07460

[51] Int. Cl.[6] ..... C11D 17/00; C11D 3/37; C11D 11/00

[52] U.S. Cl. ..... 510/224; 510/230; 510/446; 510/476

[58] Field of Search ..... 510/224, 230, 510/298, 445, 446, 444, 476, 533; 252/FOR 232, FOR 245

[56] References Cited

U.S. PATENT DOCUMENTS

| | | | |
|---|---|---|---|
| 5,358,655 | 10/1994 | Kruse et al. | 510/224 |
| 5,382,377 | 1/1995 | Raehse et al. | 510/445 |
| 5,658,874 | 8/1997 | Davies et al. | 510/446 |
| 5,883,061 | 3/1999 | Duccini et al. | 510/224 |

FOREIGN PATENT DOCUMENTS

| | | |
|---|---|---|
| 989683 | 3/1962 | United Kingdom . |
| 2040980 | 6/1978 | United Kingdom . |
| WO 92/18604 | 10/1992 | WIPO . |

*Primary Examiner*—Ardith Hertzog
*Attorney, Agent, or Firm*—James G. Vouros; Wendy A. Choi

[57] ABSTRACT

A detergent tablet is disclosed which comprises at least 50 wt. % of a non-phosphate builder and from 0 to 20 wt. % of a phosphate builder, and has incorporated therein as binder from 0.3 to 5 wt. % of a neutralised polymer of hydrophilic or hydrophobic monomers which have a glass transition temperature (Tg) of from 40 to 120° C., which monomers comprise(meth)acrylic acid, maleic anhydride, alkyl (meth) acrylates, alkylhydroxy (meth)acrylates, or styrene, the polymer having a weight average molecular weight of from 10,000 to 120,000.

9 Claims, No Drawings

LOW/NON-PHOSPHATE DETERGENT TABLETS COMPRISING NEUTRALIZED POLYMER BINDER INCORPORATED THEREIN

This is a continuation of U.S. application Ser. No. 08/872,038, filed Jun. 10, 1997, now U.S. Pat. No. 5,883,061. The latter copending application is hereby incorporated by reference.

The present invention relates to detergent tablets and bars, and more specifically to tablets and bars of detergents which contain high levels of non-phosphate ingredients.

In the past, phosphates have been used in detergents generally to avoid calcium salt precipitation. Detergents containing phosphates could be made with the same formulation in both powder and tablet form, because phosphates impart good tabletising properties. However nowadays phosphates are generally used in detergents either at very low levels or not at all, and instead other builders such as zeolite, citrates, silicates, layered silicates, disilicates etc are employed. These builders are generally available in powder or granular form, and can easily be dry mixed or granulated in powdered detergent formulations. However their granulometry and other physical properties are such that tabletising the powder formulation is very difficult. Hence in order to tabletise such formulations, it has generally been necessary to reformulate the detergent, or to add binding agents to the powder before tabletising.

Examples of such binding agents include fatty alcohols or fatty acids such as lauryl alcohol or stearic acid. For example GB 989683A discloses coating a detergent tablet with a water-soluble film-forming polymer such as polyvinyl alcohol. However they are generally difficult to use because they are solids at room temperature, and also reduce the dissolution rate of the tablet, which is undesirable in a detergent.

Other binders used include sodium salts of homo- or copolymeric (meth)acrylic acid, as disclosed in EP 579659A, which are agglomerated with the other components of the detergent, the agglomerate then being dried and tableted. Tablets produced with such binders have improved physical and solubilization properties; however these properties are still capable of improvement to be comparable with those of tablets which do contain phosphate builders for example.

To manufacture bar or tablet detergents extrusion is often used, and manufacturers frequently experience difficulties in maintaining satisfactory mechanical resistance in the bars, which often break during production, handling or storage.

An alternative to incorporating binders within a formulation to be tableted is to tablet the formulation and then coat the tablet with a compound which will improve its resistance to breakage and rapid dissolution. However tablets which have only an external coating of such a material tend to dissolve too rapidly once the outer coating has been removed during the wash, which results in inferior washing results. Furthermore, coating a preformed tablet is of course an extra step in the manufacturing process, which is not preferred. GB 2040980 discloses coating a detergent tablet with polyoxyalkylene nonionic surfactants, although in this case the coating is present for its surfactant properties.

Thus there is a need for a detergent tablet containing high levels of non-phosphate builder which has suitably robust physical properties, particularly which is non crumbling and non dusting, which can be manufactured economically, and which provides detergency results as good as or better than existing tablets. We have discovered that such a tablet can be achieved by tableting a particulate detergent formulation which has been pre-mixed with a particular range of polymeric binders, such that the binder material is incorporated throughout the tablet, rather than only on the surface.

Accordingly in one aspect the present invention provides a detergent tablet which comprises at least 50 wt. % of a non-phosphate builder and from 0 to 20 wt. % of a phosphate builder, having incorporated therein as binder from 0.3 to 5 wt. % of a neutralised polymer of hydrophilic or hydrophobic monomers which have a glass transition temperature (Tg) of from 40 to 120° C., which monomers comprise (meth)acrylic acid, maleic anhydride, alkyl (meth)acrylates, alkylhydroxy (meth)acrylates, or styrene, the polymer having a weight average molecular weight of from 10,000 to 120,000. By "incorporated therein" we mean that the binder is distributed throughout the body of the tablet, and is not just a coating on the surface.

The non-phosphate builder preferably comprises citrates, silicates, disilicates, zeolite, carbonates, bicarbonates. Other organic chelants may also be employed.

A further aspect of the invention provides a process for producing a detergent tablet which comprises the steps of a) agglomerating a composition comprising at least 50 wt. % of a non-phosphate builder and from 0 to 20 wt. % of a phosphate builder, and from 0.3 to 5 wt. % of a neutralised polymer of hydrophilic or hydrophobic monomers which have a glass transition temperature (Tg) of from 40 to 120° C., which monomers comprise(meth)acrylic acid, maleic anhydride, alkyl (meth)acrylates, alkylhydroxy (meth) acrylates, or styrene, the polymer having a weight average molecular weight of from 10,000 to 120,000, and then b) tableting the resulting agglomerate.

The amount of phosphate builder if present may be 5 wt. % or less; preferably it is from 0 to 1 wt. %, and more preferably from 0 to 0.1 wt. %.

It is necessary for the polymer to be neutralised in order for it to be soluble. The weight average of the polymer is preferably from 25,000 to 95,000, most preferably from 40000 to 50000, and its Tg preferably between 40 and 100° C. Preferred levels in the tablet are from 0.5 to 2 wt. %.

Detergent tablets made according to the invention are found to have excellent physical properties compared with known tablets having high levels of non-phosphate builders.

EXAMPLES

| Dishwashing tablet formulation A (all amounts are percentages by weight) | |
|---|---|
| Sodium citrate dihydrate | 35 |
| Carbonate | 8 |
| Perborate | 10 |
| Tetraacetylethylenediamine (TAED) | 3 |
| Na salt of polyacrylic acid (MW 4500) | 4.5 |
| Nonionic surfactant (Plurafac LF 403) | 1 |
| Bicarbonate | 38–38.5 |
| Tableting aid | 0–0.5 |

Dishwashing tablets were formulated according to the above formulation, each containing a different tableting aid, as listed in Table I below. The tablets were then evaluated visually and also for hardness using a Schleuninger tablet tester 60. The results are given below. Hardness was evaluated after one hour's ageing, and is measured in kPa.

MMA=methyl methacrylate, MAA=methacrylic acid, BA=butyl acrylate, HEMA=hydroxyethylmethacrylate, EHA=2-hydroxyethylacrylate, BMA=butyl methacrylate, AN=acrylonitrile and AA=acrylic acid.

TABLE I

| Tableting aid | Mw | Hardness | Tg | Visual appearance |
|---|---|---|---|---|
| None | | 0 | | Impossible to tabletise |
| 0.5% water | | 3.5 | | Wet and crumbling |
| 47MMA/25BA/18MAA/10HEMA | 45000 | 20.5 | 95° C. | Excellent |
| 47MMA/25BA/18MAA/10HEMA | 88000 | 13.0 | 98° C. | Acceptable |
| 47MMA/25BA/18MAA/10HEMA | 116000 | 5.0 | 100° C. | Wet and crumbling |
| 47MMA/25BA/18MAA/10HEMA | 148000 | 5.0 | 99° C. | Very crumbling |
| 52.5MMA/29.5BA/18MAA | 20000 | 17.0 | 80° C. | Good |
| 40 Styrene/30EHA/25AN/5MAA | 55800 | 12.5 | 51° C. | Acceptable |
| 80EHA/20AA | 15000 | 11.0 | | Acceptable |
| 62BMA/38AA | 10000 | 4.5 | | Wet and crumbling |
| Polyurethane | | 2.5 | | Wet and crumbling |

"Acceptable", "Good" and "Excellent" refer to the tablet's hardness and resistance to crumbling and also to the visual impression. "Acceptable" for instance means that although a proper tablet is formed, the edges of the tablet are not very sharp and the surface is somewhat uneven.

II—Dishwashing Tablets Formulated According to EP 579659A

Formulation B was prepared according to the teaching of EP 579659A, and then evaluated for its physical properties with added tableting aid. The tableting aid employed had the formulation 47MMA/25BA/18MAA/10HEMA, Mw 45000, Tg about 98° C.

| FORMULATION B: | |
|---|---|
| Sodium carbonate | 46.7% |
| Sodium sulphate | 1% |
| Copolymer dry* | 10.2% |
| Sodium citrate | 10.3% |
| Sodium disilicate | 20.5% |
| Sodium perborate monohydrate | 7.1% |
| TAED | 2.1% |
| Nonionic surfactant | 2.1% |

| | HARDNESS | Comments | Visual aspect |
|---|---|---|---|
| FORMULATION B + 0.5% water | tablet broken | capping | medium |
| FORMULATION B + 0.5% tableting aid | 15.0 | no capping | good |

*sodium salt of a copolymer of acrylic and maleic acid

By "capping" is meant that after pressing the top and bottom surfaces of the tablet are compressed by the pressing machine to such an extent that they detach from the body of the tablet as laminar portions, the main body of the tablet being of a less solid consistency.

III—Washing Tests

The above mentioned formulations were tested for performance in comparison with commercially available tablets.

Commercial tablet 1 contains:

<5% nonionic surfactant

5–15% oxygenated bleach

>30% phosphate enzymes Commercial tablet 2 contains:

<5% nonionic surfactant

5–15% oxygenated bleach, polycarboxylate enzymes, carbonate, citrate, activator, perfume Conditions: 1 tablet/wash Soil : milk+margarine Water : 600 ppm hardness as $CaCO_3$ Scale: 0=perfect 4=heavy filming on glasses

| DETERGENT | Commercial tablet 1 | A - no tableting aid | A + 0.5% tableting aid |
|---|---|---|---|
| QUANTITIES | 25.5 g | 23.8 g (as powder) | 23 g |
| Filming/spotting 4 cycles | 0/1 | 1/1 | 0/0 |
| Filming/spotting 8 cycles | 0.5/1 | 1.5/1.5 | 1/0 |

Note: Formulation A does not contain enzymes which would improve performance.

IV—Detergency

Evaluations were made of wood patches impregnated with tea. Thin strips of wood, laminated on one side with plastic, were impregnated on the other side with tea, and the whiteness of the patch evaluated before and after washing.

| | Commercial 1 | Formulation A | Formulation A + 0.5% tab aid |
|---|---|---|---|
| Whiteness before washing | 77.38 | 75.56 | 76.12 |
| Whiteness after washing (higher the better) | 80.34 | 82.86 | 82.60 |
| Yellow scale before wash | 2.85 | 3.85 | 3.18 |
| Yellow scale after wash (lower the better) | 1.67 | 0.37 | 0.31 |

The above results demonstrate that the presence in the formulation of tableting aid does not have a detrimental effect on either detergency performance or bleach stability.

V—Variation on Formulations

A further detergent formulation was prepared with the composition given below, and tablets formulated with 0.5% of the tableting aid were evaluated for hardness.

| | C |
|---|---|
| Citrate | 20% |
| Carbonate | 8% |
| Perborate | 10% |
| TAED | 3% |
| Homopolymer | 4.5% |
| Nonionic surfactant | 1% |
| Bicarbonate | 53.5% |
| Disilicate | 0 |

-continued

| Results: tablets' hardness after ageing for 1 hour | |
|---|---|
| Formulation | Hardness (kPa) |
| A + 0.25% Tableting Aid | 12 |
| A + 0.5% Tableting Aid | 19 |
| B + 0.5% Tableting Aid | 20 |
| C + 0.5% Tableting Aid | 18 |

VI—Dissolution Rates

Tablets were placed in a wire basket in a typical glass fronted dishwasher, and the time to dissolve completely during a typical washing cycle observed visually.

| | |
|---|---|
| Commercial 1 | 22 minutes |
| Commercial 2 | 33 minutes |
| Formulation B | 27 minutes |
| Formulation A + T.Aid | 24 minutes |
| Formulation B + T.Aid | 21 minutes |

Commercial tablets 1 and 2 start dissolving a little later and then fall apart suddenly when wet. Formulations A+Tableting Aid and B+Tableting Aid dissolve more regularly from the early beginning to the end of wash cycles.

We claim:

1. A detergent tablet comprising at least 50 wt. % of a non-phosphate builder and from 0 to 20 wt. % of a phosphate builder, having incorporated therein as binder from 0.3 to 5 wt. % of a neutralised polymer having a glass transition temperature (Tg) of from 40 to 120° C. and a weight average molecular weight of from 10,000 to 120,000; wherein the polymer comprises monomeric units of 52.5 wt % methyl methacrylate, 29.5 wt. % butyl acrylate and 18 wt. % methacrylic acid.

2. Tablet according to claim 1, wherein the polymer has a molecular weight of 25,000 to 95,000.

3. Tablet according to claim 1, wherein the polymer has a molecular weight of 40,000 to 50,000.

4. Tablet according to claim 1 wherein the polymer has a Tg of between 40 and 100° C.

5. Tablet according to claim 1, wherein the amount of phosphate builder is from 0 to 5 wt. %.

6. Tablet according to claim 1, wherein the amount of phosphate builder is from 0 to 1 wt. %.

7. Tablet according to claim 1 wherein the amount of phosphate builder is from 0 to 0.1 wt. %.

8. Tablet according to claim 1, wherein the non-phosphate builder comprises citrate, silicate, disilicate, zeolite, carbonate or bicarbonate.

9. Process for producing a detergent tablet which comprises the steps of a) agglomerating a composition comprising at least 50 wt. % of a non-phosphate builder and from 0 to 20 wt. % of a phosphate builder, having incorporated therein as binder from 0.3 to 5 wt. % of a neutralised polymer having a glass transition temperature (Tg) of from 40 to 120° C. and a weight average molecular weight of from 10,000 to 120,000; wherein the polymer comprises monomeric units of 52.5 wt. % methyl methacrylate, 29.5 wt. % butyl acrylate and 18 wt. % methacrylic acid; and the b) tableting the resulting agglomerate.

* * * * *